United States Patent [19]

Mruck et al.

[11] 4,002,300

[45] Jan. 11, 1977

[54] CHIP-FORMING APPARATUS

[75] Inventors: Hans-Joachim Mruck, Bielefeld; Gerhard Maier, Brackwede, both of Germany

[73] Assignee: Maschinenfabrik B. Maier K.-G., Brackwede, Germany

[22] Filed: Apr. 22, 1975

[21] Appl. No.: 570,482

[30] Foreign Application Priority Data

Apr. 26, 1974 Germany ..... 2420189

[52] U.S. Cl. ..... 241/37.5; 241/166; 241/244; 241/285 A

[51] Int. Cl.[2] ..... B02C 18/14

[58] Field of Search ..... 241/36, 37.5, 86, 166, 241/188 R, 248, 285 A, 244

[56] References Cited

UNITED STATES PATENTS

| | | | |
|---|---|---|---|
| 856,963 | 6/1907 | Latsch | 241/166 X |
| 1,789,539 | 1/1931 | Borton | 241/166 |
| 2,836,401 | 5/1958 | Phelan | 241/166 X |
| 3,289,952 | 12/1966 | Merges et al. | 241/188 R X |
| 3,749,325 | 7/1973 | Maier | 241/86 |

FOREIGN PATENTS OR APPLICATIONS

| | | | |
|---|---|---|---|
| 151,556 | 11/1968 | U.S.S.R. | 241/166 |

*Primary Examiner*—Granville Y. Custer, Jr.
*Assistant Examiner*—Howard N. Goldberg
*Attorney, Agent, or Firm*—Herbert L. Lerner

[57] ABSTRACT

Chip-forming apparatus including housing means having a peripheral inner wall surface, a cutter cage mounted within the housing means and spaced from the peripheral inner wall surface, the cutter cage having a plurality of chip-cutting blades, means for feeding coarse material to the cutter cage to be formed into chips by the chip-cutting blades and hurled radially outwardly against the peripheral inner wall surface, and cleaning means mounted in the housing means adjacent the peripheral inner wall surface thereof and revolvable in brushing engagement with the inner wall surface.

6 Claims, 2 Drawing Figures

CHIP-FORMING APPARATUS

Figure 1:
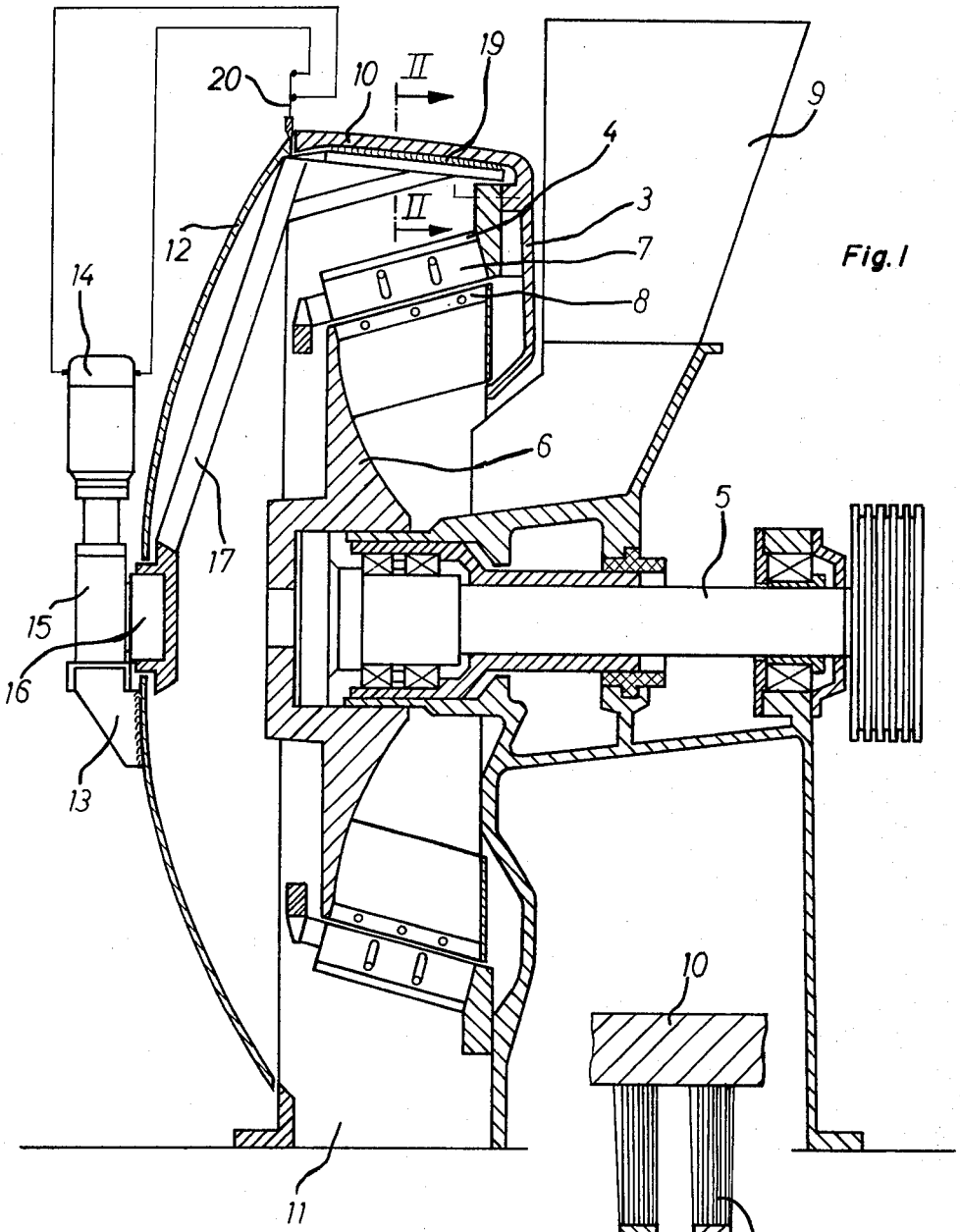

The invention relates to a chip-forming apparatus, especially for precomminuted wood or wood waste, wherein a cutter cage is fixedly or revolvably mounted in a housing and wherein the chips that are formed are hurled radially outwardly against the inner wall surface of the housing, which peripherally surrounds the cutter cage.

Such chip-forming apparatus primarily produce wood chips and shavings for chip board or pressed wood panel manufacture from wood residue i.e. previously comminuted wood, such as slabs, edgings and the like. Other materials can also be processed in such apparatus, however, such as synthetic materials or materials similar to wood, for example bamboo or sugar cane. In chip-forming apparatus having a fixed or stationary cutter cage, a rotor rotates within the cutter cage and is provided with a rotary impeller having edges at the radially outer ends thereof which serve as counter blades cooperating with the cutter blades of the cutter cage. The material that is to be formed into chips is fed centrally to the rotor and further advanced radially through the cutter cage in which it is comminuted into chips, which are then discharged from the housing through an opening at the bottom thereof (German Published Non-Prosecuted Application DT-OS 2 131 262). The relationships in such apparatus are similar to those in chip-forming apparatus having a revolving cutter cage (German Patent 940 446). Also in the latter apparatus, the material formed into chips in the cutter cage is hurled from the latter against the inner wall surface of the housing.

When wood having an exceptionally high moisture content, such as over 200%, is processed in such apparatus, the extremely moist chips that are hurled radially out of the cutter cage at relatively high speed against the inner wall surface of the housing surrounding the cutter cage adhere to the wall surface like wet snow. A build-up of the thus adhering chips occurs radially inwardly from the inner wall surface of the housing in a relatively short time so that chip discharge from the housing is blocked and the apparatus or machine becomes fully clogged and inoperative.

It is accordingly an object of the invention to provide a chip-forming apparatus of the aforedescribed type which assures unobstructed discharge of the chips that are formed even when the material being processed in the apparatus contains a relatively high moisture content.

With the foregoing and other objects in view, there is provided in accordance with the invention, a chip-forming apparatus comprising housing means having a pheripheral inner wall surface, a cutter cage mounted within the housing means and spaced from the peripheral inner wall surface, the cutter cage having a plurality of chip-cutting blades, means for feeding coarse material to the cutter cage to be formed into chips by the chip-cutting blades and hurled radially outwardly against the peripheral inner wall surface, and cleaning means mounted in the housing means adjacent the peripheral inner wall surface thereof and revolvable in brushing engagement with the inner wall surface.

Through such cleaning means which, further in accordance with the invention comprises at least one brush, all of the chips which settle on the inner wall surface of the housing are immediately removed therefrom.

In accordance with another feature of the invention, the cleaning means is connected directly to the rotor which revolves the cutter cage.

In accordance with a further feature of the invention and in order to avoid the necessity of constructing the cleaning means especially sturdily due to the large centrifugal forces occurring at the high rotary speed required for revolving the cutter cage, due to which the revolving masses would become relatively large, the cleaning means are therefore provided with a rotary drive system which is independent of that which drives the cutter cage. The drive system for the cleaning means can accordingly revolve the latter at a considerably lower speed, such as less than 10 r.p.m., for example, and need be switched on only when it is absolutely necessary e.g. only when the material which is being processed by the apparatus contains such a degree of moisture that the chips that would be formed therefrom would adhere to the inner wall surface of the housing.

In accordance with an additional feature of the invention, a door is provided at an end face of the housing which is openable to afford access to the cutter cage within the housing, and a drive motor is mounted outside the door for driving the cleaning means.

In the interest of safety, there are provided, in accordance with an added feature of the invention, means for interrupting the supply of energy to the drive motor for the cleaning means when the door is opened.

Other features which are considered as characteristic for the invention are set forth in the appended claims.

Although the invention is illustrated and described herein as embodied in a chip-forming apparatus, it is nevertheless not intended to be limited to the details shown, since various modifications and structural changes may be made therein without departing from the spirit of the invention and within the scope and range of equivalents of the claims.

Figure 2:
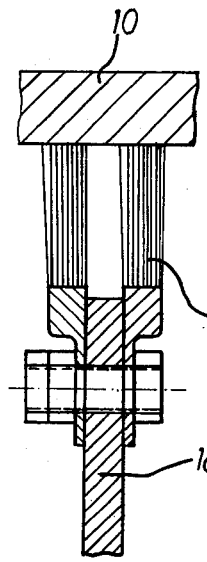

The construction and method of operation of the invention, however, together with additional objects and advantages thereof will be best understood from the following description of specific embodiments when read in connection with the accompanying drawings, in which:

FIG. 1 is a vertical sectional view of the chip forming machine constructed in accordance with the invention; and FIG. 2 is a sectional view of FIG. 1 taken along the line II—II in the direction of the arrows.

Referring now to the drawing and first, particularly, to FIG. 1 thereof, there is shown a chip forming machine according to the invention which has a housing 3 in which a stationary cutter cage or cluster 4 is disposed which surrounds a rotor 6 coaxially mounted on the shaft 5 and driven by a non-illustrated motor. Cutter blades 7 fastened at the cutter cage or cluster 4 cooperate with cleavage knives 8 located at the periphery of the rotor 6 and form chips from coarse material such as pieces of wood waste, charged into an inlet hopper 9. The rotor 6 advances the coarse material radially outwardly against a wall 10 of the housing 3 that peripherally surrounds the cutter cage or cluster 4.

The chips that are formed are discharged from the machine housing 3 through an outlet 11. The housing 3 is closed at one face thereof by a front door 12. A drive motor 14 with a gear transmission system 15 is mounted at the outside on a console or bracket 13 welded to the front door 12, a driven pivot pin or drive shaft 16 of the transmission system 15 being disposed centrally of the front door 12 and projecting therethrough into the housing 3. Inside the front door 12, a substantially radially extending arm 17 is fastened at the radially inner end thereof to the pivot pin 16. The radially outer end of the arm 17 carries substantially axially extending brushes 19 braced by a strut 18. As the arm 17 revolves at the inner side of the housing wall 10 peripherally surrounding the cutter cage or cluster 4, the brushes 19 brush against and along the inner surface of the wall 10 and strip therefrom moist chips that have remained suspended thereon and deliver them to the chip discharge outlet 11. Instead of the one arm 17 illustrated in the figure, two or more arms can also be attached to the driven pin 16.

If the door 12 is opened while the brushes 19 are revolving, a switch 20 is tripped, interrupting the supply of energy to the drive motor 14 and, accordingly stopping the rotation of the pivot pin 16 and the revolving of the brushes 19.

It is claimed:

1. Chip-forming apparatus comprising housing means having a peripheral inner wall surface, a cutter cage mounted within said housing means and spaced from said peripheral inner wall surface, said cutter cage having a plurality of chip-cutting blades, means for feeding coarse material to said cutter cage to be formed into chips by said chip-cutting blades and hurled radially outwardly against said peripheral inner wall surface, rotatable first drive shaft means disposed in said housing means and connected with a rotor having cleavage knives at its periphery, said cleavage knives cooperating with said cutter cage, cleaning means mounted in said housing means adjacent said peripheral inner wall surface thereof, and second drive shaft means rotatable independently of said first drive shaft means, said cleaning means being carried by said second drive shaft means and being rotatable therewith in brushing engagement with said inner wall surface.

2. Chip-forming apparatus according to claim 1 including an arm extending from said second drive shaft means and carrying said cleaning means.

3. Chip-forming apparatus according to claim 2 wherein said cutter cage has a substantially circular cross section, and said second drive shaft means are disposed in said housing means substantially coaxially to said cutter cage, said arm extending radially from said drive shaft means, said cleaning means comprising at least one brush mounted on said arm.

4. Chip-forming apparatus according to claim 1 wherein said housing means is formed at an end face thereof with a door openable so as to afford accessibility to said cutter cage within said housing means, and including a drive motor mounted outside said door for driving said second drive shaft means.

5. Chip-forming apparatus according to claim 4 including means for supplying energy to said drive motor for driving the same, and means for interrupting the energy supply when said door is opened.

6. Chip-forming apparatus according to claim 1 wherein said cleaning means is at least one brush.

* * * * *